US011305531B2

(12) United States Patent
Teshima et al.

(10) Patent No.: US 11,305,531 B2
(45) Date of Patent: Apr. 19, 2022

(54) LIQUID EJECTION HEAD AND LIQUID EJECTING APPARATUS

(71) Applicant: CANON KABUSHIKI KAISHA, Tokyo (JP)

(72) Inventors: Takayuki Teshima, Yokohama (JP); Toshio Kashino, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/988,188

(22) Filed: Aug. 7, 2020

(65) Prior Publication Data

US 2021/0039389 A1 Feb. 11, 2021

(30) Foreign Application Priority Data

Aug. 9, 2019 (JP) ..... JP2019-147528

(51) Int. Cl.
*B41J 2/14* (2006.01)
*B41J 2/165* (2006.01)

(52) U.S. Cl.
CPC ..... *B41J 2/14072* (2013.01); *B41J 2/16535* (2013.01); *B41J 2/16538* (2013.01); *B41J 2002/14491* (2013.01); *B41J 2202/18* (2013.01)

(58) Field of Classification Search
CPC ..... B41J 2/14072; B41J 2/16535; B41J 2002/14491; B41J 2202/18; B41J 2/16538
See application file for complete search history.

(56) References Cited

U.S. PATENT DOCUMENTS 6,764,165 B2 * 7/2004 Aschoff ..... B41J 2/14072 347/50
6,799,841 B2 10/2004 Iri et al.
7,025,441 B2 4/2006 Kashino et al.

FOREIGN PATENT DOCUMENTS

JP 2001-138520 A 5/2001

OTHER PUBLICATIONS

U.S. Appl. No. 17/027,114, Toshio Kashino, filed Sep. 21, 2020.

* cited by examiner

*Primary Examiner* — Geoffrey S Mruk
(74) *Attorney, Agent, or Firm* — Venable LLP

(57) ABSTRACT

A liquid ejection head includes a substrate; an energy generator that is provided on the substrate; an electrode portion that is provided on the substrate; a liquid ejection face that is provided near a surface of the substrate having the electrode portion; and flexible printed circuits including a conductive pattern and a base material having a first surface and a second surface, the first surface having the conductive pattern, the second surface being provided on the opposite side from the first surface. The base material of the flexible printed circuits has a leading region from the terminal end of a region having the conductive pattern to an end of the base material near the energy generator, without formation of the conductive pattern in the leading region, and at least a part of the second surface of the leading region inclines toward the substrate.

12 Claims, 8 Drawing Sheets

LIQUID EJECTION HEAD AND LIQUID EJECTING APPARATUS

BACKGROUND OF THE INVENTION

Field of the Invention

The present invention relates to a liquid ejection head and a liquid ejecting apparatus that are used for, for example, ink jet recording.

Description of the Related Art

An ink jet recording head disclosed in Japanese Patent Application Laid-Open No. 2001-138520 is provided with a recording element substrate that includes an energy generating element and an electrode and flexible printed circuits that include an electrode terminal. The electrode terminal of the flexible printed circuits is located in a region where the flexible printed circuits and the recording element substrate overlap each other, retracting from the end of a circuit board that determines the region. The electrode terminal is connected to the electrode of the recording element substrate. Japanese Patent Application Laid-Open No. 2001-138520 also discloses a recovering operation in which cleaning is performed to remove droplets of ink on the ejection face of a recording head by wiping the ejection face.

In the recording head disclosed in Japanese Patent Application Laid-Open No. 2001-138520, a wiper may come into contact with the edge of the end of the flexible printed circuits each time a recovering operation is performed. This may scratch the wiper and reduce the durability of the wiper. A scratch on the wiper may decrease the wiping capability of the wiper, leaving ink droplets. This may interfere with a desired recovering operation and lead to difficulty in keeping high-quality recording for a long time period.

An object of the present invention is to provide a liquid ejection head capable of suppressing damage to a wiper during a recovering operation. Another object of the present invention is to provide a liquid ejecting apparatus capable of suppressing damage to a wiper during a recovering operation.

SUMMARY OF THE INVENTION

According to one aspect of the present invention, there is provided a liquid ejection head including: a substrate; an energy generator that is provided on the substrate and generates energy for ejecting liquid; an electrode portion that is provided on the substrate and is electrically connected to the energy generator; a liquid ejection face that is provided near a surface of the substrate having the electrode portion; and flexible printed circuits including a conductive pattern electrically connected to the electrode portion and a base material having a first surface and a second surface, the first surface having the conductive pattern and being opposed to the surface of the substrate having the electrode portion, the second surface being provided on the opposite side from the first surface, wherein the base material of the flexible printed circuits has a leading region from the terminal end of a region having the conductive pattern to an end of the base material near the energy generator, without formation of the conductive pattern in the leading region, and at least a part of the second surface of the leading region inclines toward the substrate.

Further features of the present invention will become apparent from the following description of exemplary embodiments with reference to the attached drawings.

DESCRIPTION OF THE EMBODIMENTS

Figure 1:
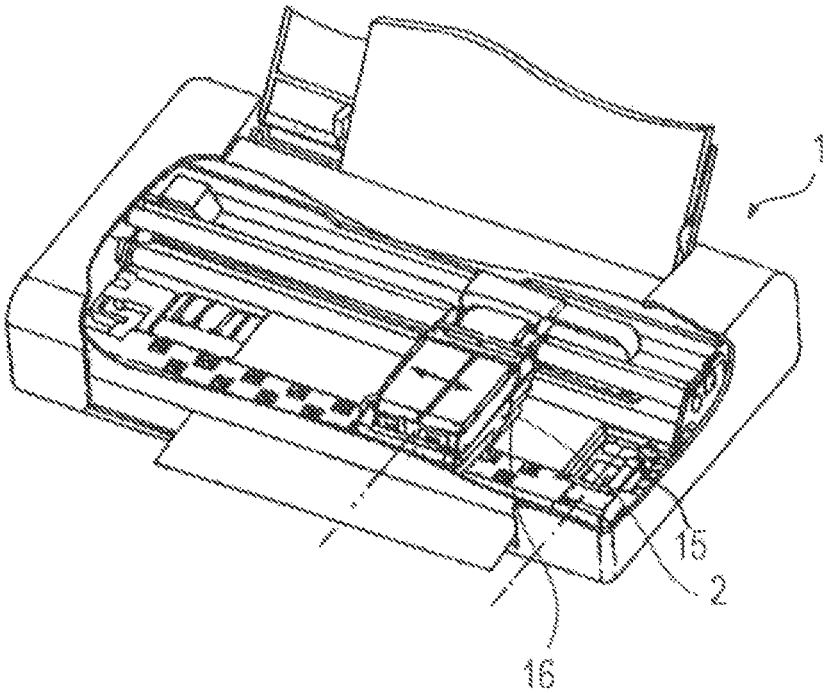
FIG. 1 is a perspective view illustrating an example of a liquid ejecting apparatus.

Preferred embodiments of the present invention will now be described in detail in accordance with the accompanying drawings.

Exemplary embodiments of the present invention will be specifically described below in accordance with the accompanying drawings. In the drawings, the same materials are indicated by the same reference numerals and an overlapping explanation is omitted or simplified.

FIG. 1 is a perspective view illustrating an example of a liquid ejecting apparatus 1 in which a liquid ejection head of the present invention can be used. During a recovering operation of a liquid ejection face 16 of a liquid ejection head 2, the liquid ejection face 16 is cleaned by wiping the liquid ejection face 16 with a wiper 15 so as to remove droplets of ink thereon.

As illustrated in FIGS. 2A to 4B, a substrate 3 of the liquid ejection head according to the present invention is provided with an energy generator 4 for ejecting liquid and a wire 5 for feeding power to the energy generator 4. On the wire 5, a bump 6 (electrode portion) is optionally disposed with an electrode pad 20 appropriately interposed between the wire 5 and the bump 6. The configuration electrically connects the energy generator 4 and the bump 6. The bump 6 is provided so as to protrude from the upper side of the substrate 3. A conductive pattern 9 is provided on a surface of flexible printed circuits (or flexible printed circuit board) 7 so as to be adjacent to the substrate 3 (opposed to the substrate 3). The surface having the conductive pattern 9 on the flexible printed circuits 7 (specifically, a base film 24 which will be described later) is a first surface 8. The flexible printed circuits 7 (base film 24) have a second surface 13 on the opposite side from the first surface. The bump 6 is electrically connected to the conductive pattern 9. An electrical connection portion 10 between the conductive pattern 9 and the bump 6 is covered with a sealer 11.

Figure 2A:
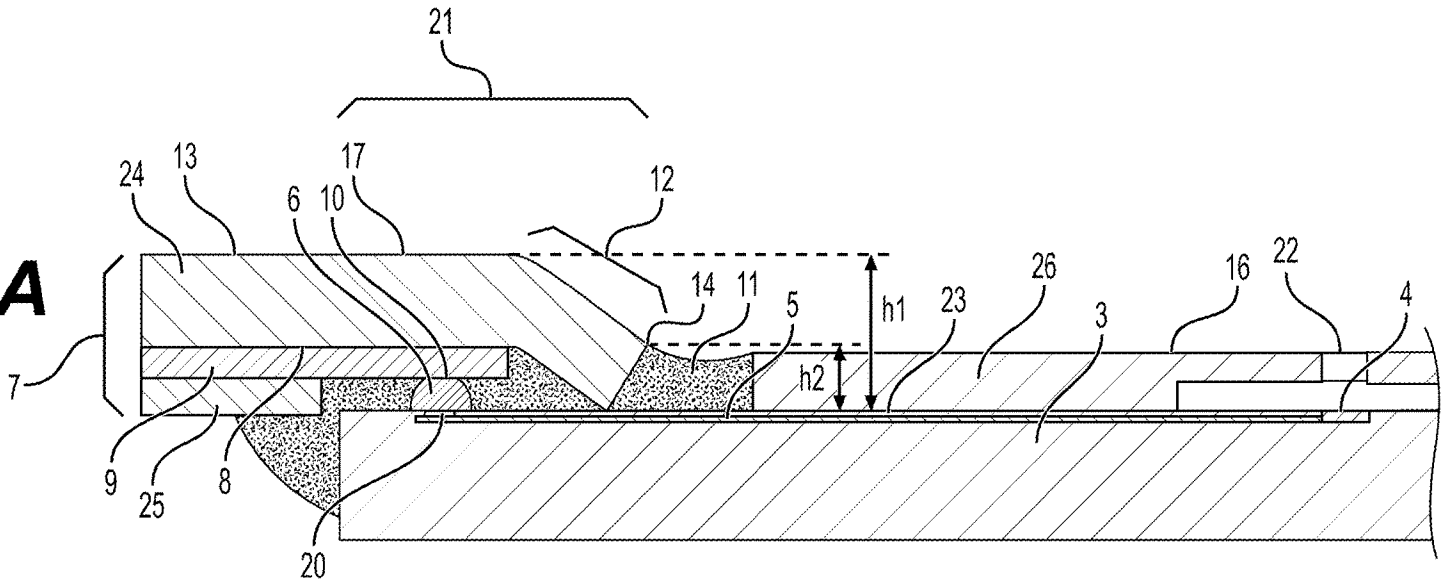
FIG. 2A is a cross-sectional view illustrating a liquid ejection head according to a first embodiment.

The flexible printed circuits 7 (particularly the base film 24) have a region 12, in which the conductive pattern is not formed, from the terminal end of the region of the conductive pattern to an end 14 near the energy generator (the right side of FIG. 2A). Hereinafter, the end 14 may be referred to as "leading end" and the region 12 may be referred to as "leading region." Moreover, a region 21 where the substrate 3 and the flexible printed circuits 7 overlap each other may be referred to as "overlapping region." At least part of the conductive pattern 9 is located within the overlapping region 21 so as to retract from the leading end 14. The leading region preferably has a length of at least 100 μm (the distance of retraction of the conductive pattern 9 from the leading end 14) and more preferably has a length of at most 300 μm.

The second surface 13 of the leading region 12 of the flexible printed circuits 7 inclines toward the substrate 3. The second surface 13 of the leading region 12 may entirely incline but the inclination is not particularly limited. At least a part of the second surface 13 of the leading region 12 may incline such that a height h2 of an edge formed by the end face and the second surface of the leading end 14 is lower than a height h1 of an uppermost part 17 of the flexible printed circuits 7. In this case, a height means a distance from a substrate surface (a surface of the substrate 3, the flexible printed circuits 7 being connected to the surface). The uppermost part 17 of the flexible printed circuits 7 means the highest part of the flexible printed circuits 7 (particularly the second surface 13) in the overlapping region 21. A difference between the height h1 of the uppermost part 17 and the height h2 of the edge is preferably 10 μm or larger, and more preferably 100 μm or larger.

X direction is a direction from the conductive pattern 9 to the leading end 14 (parallel to the longitudinal direction of the flexible printed circuits 7, to the right in FIG. 2A). Y direction is a direction orthogonal to X direction (parallel to the width direction of the flexible printed circuits 7, a direction from the inside toward a viewer in FIG. 2A). For example, the second surface 13 may incline toward the substrate 3 in X direction over the leading region 12. The inclination is not particularly limited. The second surface 13 may incline in X direction only in a part of the leading region 12.

In view of suppression of damage to the wiper 15, as mentioned above, the second surface 13 can have an inclined part in Y direction over the leading region 12. In other words, the inclined part can be provided, but is not limited to, over the flexible printed circuits 7 in the width direction. The second surface 13 may be parallel to the substrate surface in a region other than the leading region 12 and a region where the second surface 13 does not incline in the leading region 12.

Figure 4A:
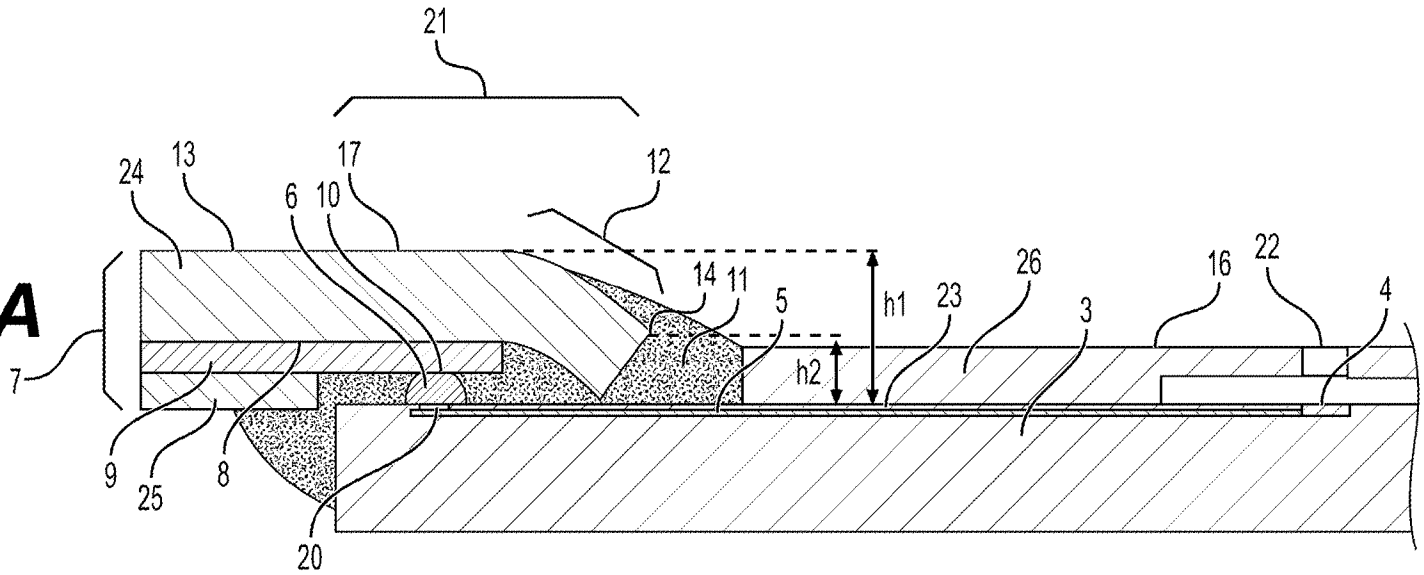
FIG. 4A is a cross-sectional view illustrating a liquid ejection head according to a third embodiment.
Figure 5A:
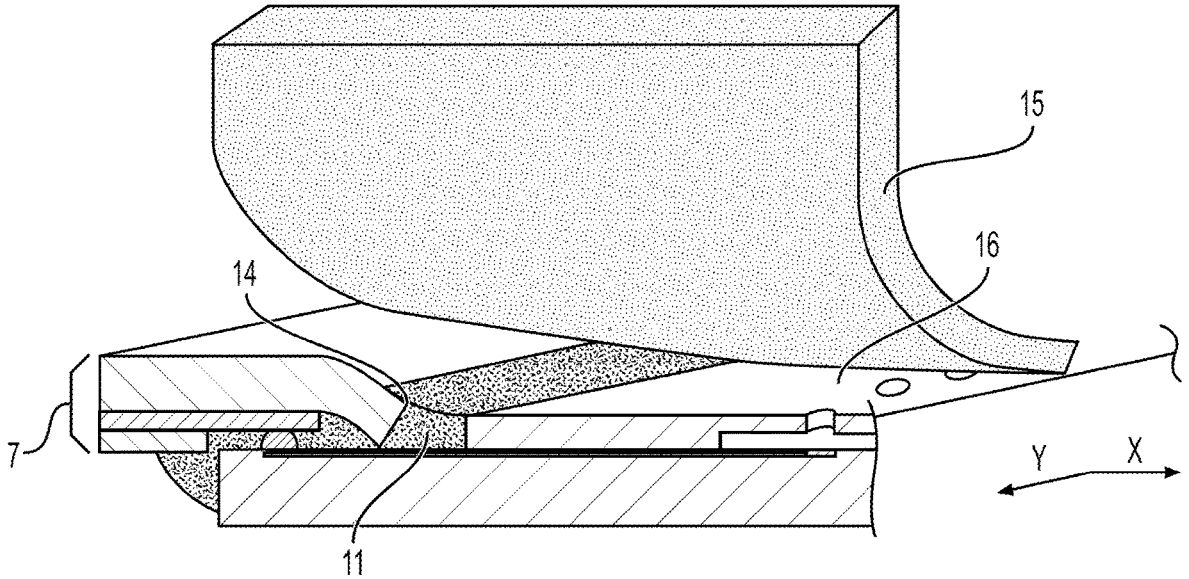
FIG. 5A is a schematic diagram for describing wiping of the liquid ejection head according to the third embodiment when a wiper is moved in parallel with the width direction of flexible printed circuits.
Figure 5B:
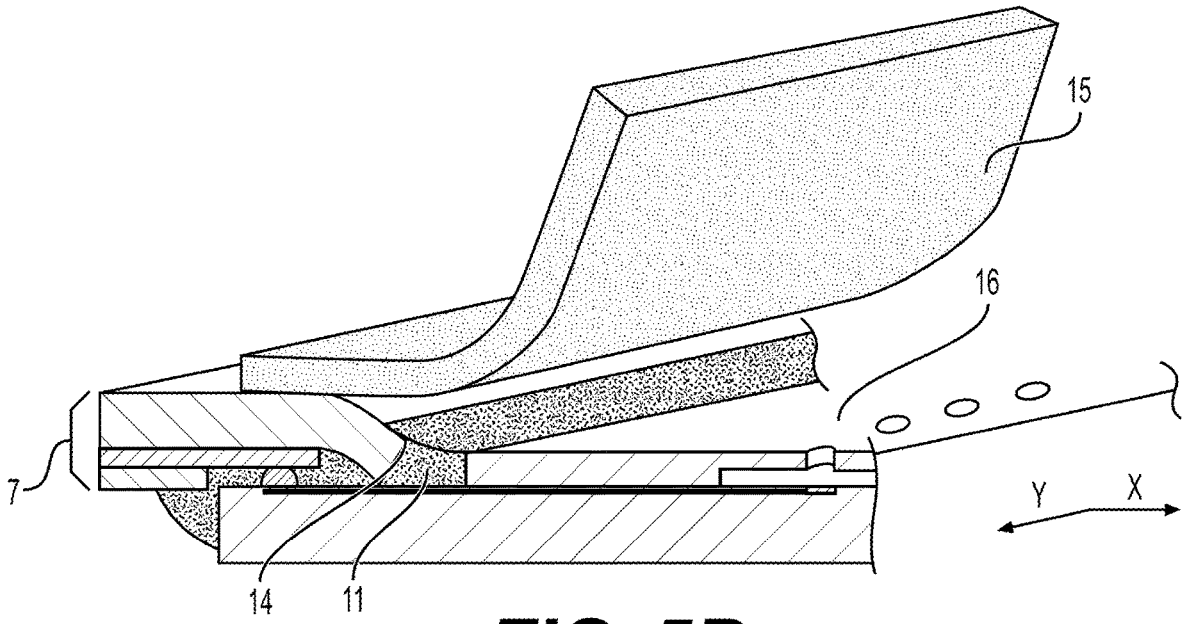
FIG. 5B is a schematic diagram for describing wiping of the liquid ejection head according to the third embodiment when the wiper is moved perpendicularly to the width direction of the flexible printed circuits.

FIGS. 5A and 5B illustrate the liquid ejection head 2 being wiped with the wiper 15. The liquid ejection head in FIGS. 5A and 5B is a liquid ejection head according to the third embodiment. In FIGS. 5A and 5B, the wiper 15 is moved in different directions that form an angle of 90°. The wiper 15 moves in Y direction in FIG. 5A and moves in X direction in FIG. 5B. In wiping, the liquid ejection head 2 and the wiper 15 may move relative to each other. As illustrated in FIG. 4A, the second surface 13 inclines toward the substrate 3 in the leading region 12. Thus, the height h2 of the edge formed by the end face of the leading end 14 and the second surface 13 is lower than the height h1 of the uppermost part 17 of the flexible printed circuits 7. This prevents the wiper 15 from coming into contact with the edge during wiping on the liquid ejection face 16 as illustrated in FIGS. 5A and 5B, thereby suppressing damage to the wiper 15.

The conductive pattern 9 is not formed in the leading region 12. Thus, even if the second surface 13 inclines, particularly even if the leading region 12 inclines along with the first surface 8 as illustrated in FIGS. 2A and 4A, the conductive pattern 9 and the substrate 3 are not electrically short-circuited.

The substrate 3 can be made of materials including glass, quartz, ceramics and silicon. Silicon is particularly preferable because fine etching pits, transistors and heaters can be fabricated in the substrate by one of a semiconductor process and an MEMS (Micro Electro Mechanical Systems) technique.

The energy generator 4 is, for example, an electrothermal converter (so-called heater). The energy generator 4 applies a pressure to liquid so as to eject the liquid from an outlet 22. The outlet 22 is formed by an outlet forming member 26 provided on the substrate.

The wire 5 can be made of a material selected from aluminum, copper, tungsten, tantalum, titanium, chromium and an alloy thereof. The wire 5 can be formed by a wire layer that includes a single layer or multiple layers. If the wire layer includes multiple layers, an insulating layer for insulation between the wire layers can be provided. The insulating layer can be made of a material selected from silicon oxide and silicon nitride. The insulating layer can be formed by any method, for example, one of chemical vapor deposition (CVD), atomic layer deposition (ALD), sputtering, thermal oxidation, vapor deposition and the sol-gel process. A barrier layer can be provided between the insulating layer and the wire layer. The barrier layer can be made of a material selected from Ti, TiN, TiW and silicon compounds such as SiC, SiOC, SiCN, SiOCN, and SiON.

A protective film 23 resistant to ejected liquid can be provided on the wire 5. The protective film 23 can be made of a material selected from silicon compounds such as SiO, SiN, SiC, SiOC, SiCN, SiOCN, and SiON. Moreover, a cavitation resistance film (not illustrated) may be provided on the protective film.

The bump 6 can be provided on the wire 5 with the electrode pad 20 interposed between the wire 5 and the bump 6. The wire 5, the electrode pad 20 and the bump 6 are electrically connected to one another. The bump 6 and the conductive pattern 9 provided on the first surface 8 of the flexible printed circuits 7 are electrically connected to each other. The bump 6 can be any one of a gold bump, a gold stud bump, an AgSn solder bump and a Cu bump.

The flexible printed circuits 7 are soft and flexible printed circuits in which the conductive pattern 9 is provided on a thin insulator. The flexible printed circuits 7 are configured such that the conductive pattern 9 made of a conductive metal is formed on the soft and thin insulating base film 24 (base material) made of materials such as polyimide and polyethylene terephthalate. The conductive pattern 9 is copper foil or copper foil coated with gold. An insulating layer called a cover layer 25 can be formed over a region unrelated to electrical connection on the conductive pattern 9.

The electrical connection portion 10 between the bump 6 and the conductive pattern 9 of the flexible printed circuits 7 is covered with the insulating sealer 11. When liquid ejected from the outlet 22 comes into contact with one of the electrical connection portion 10, the conductive pattern 9, the bump 6, and the wire 5, corrosion or a short circuit may occur. Thus, the conductive pattern 9, the bump 6 and the wire 5 are also optionally covered with the sealer 11, preventing the inflow of liquid. The sealer 11 also bonds the substrate 3 and the flexible printed circuits 7. The sealer 11 interposed between the substrate 3 and the flexible printed circuits 7 can firmly fix the conductive pattern 9 and bump 6 even if bonding power is weak between the conductive pattern 9 and bump 6. Hence, epoxy resin can be used as the sealer 11 in view of adhesion. A sealer containing one of acrylic resin and polyimide as a base resin may be used as long as desired bonding power can be obtained. The sealer 11 can be commercially available underfill. The commercially available underfill can be selected from CEL-C-3900 series and CEL-C-3730 series (trade-named by Hitachi Chemical Company Ltd.), CV5350AS (trade-named by Panasonic Corporation) and Chipcoat G8345-29 (trade-named by NAMICS Corporation).

First Embodiment

As illustrated in FIG. 2A, in the liquid ejection head 2 according to the first embodiment, the leading region 12 of the flexible printed circuits 7 (including the first surface 8 as well as the second surface 13) inclines toward the substrate 3. The overall leading region 12 in X direction particularly inclines toward the substrate 3. The leading region 12 may have a substantially constant thickness.

In the liquid ejection head 2 configured thus, the flexible printed circuits (provided with the conductive pattern 9) to be used are formed into a shape with the inclination in advance. The liquid ejection head 2 can be formed by bonding the conductive pattern 9 and the bumps 6. Alternatively, flexible printed circuits having no inclinations may be used. The leading region 12 may be inclined toward the substrate 3 after the conductive pattern 9 and the bumps 6 are bonded to each other.

The second surface 13 of the leading region 12 can be bent with a curvature at least at the starting position of the inclination. In FIG. 2A, the second surface 13 is bent with a curvature at the starting position of the inclination of the leading region 12 (the left end of the leading region 12). The second surface 13 has a flat part between the bent part and the leading end 14. The bent part may have, but is not limited to, a constant curvature. The radius of curvature of the bent part is preferably at least 200 μm and is more preferably at least 250 μm in consideration of the leading end 14 pressed to the substrate 3 so as to suppress a force that separates the flexible printed circuits 7 from the substrate 3.

Figure 8:
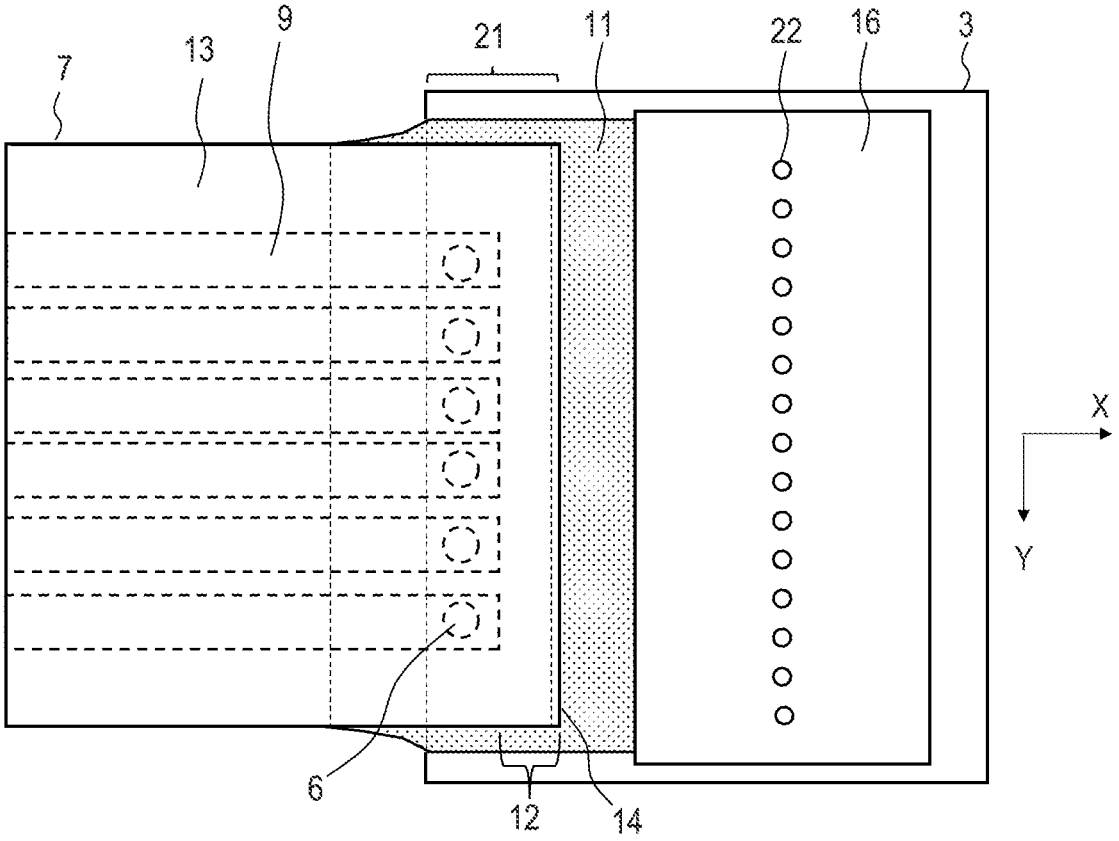
FIG. 8 is a schematic top view illustrating the liquid ejection head according to the first embodiment.

FIG. 8 is a conceptual top view illustrating the liquid ejection head according to the first embodiment. As described above, the conductive pattern 9 is located within the overlapping region 21 so as to retract from the leading end 14 near the energy generator of the flexible printed circuits 7 (X direction). The leading region 12 is provided from the terminal end of the region of the conductive pattern 9 to the leading end 14.

Second Embodiment

Figure 3A:
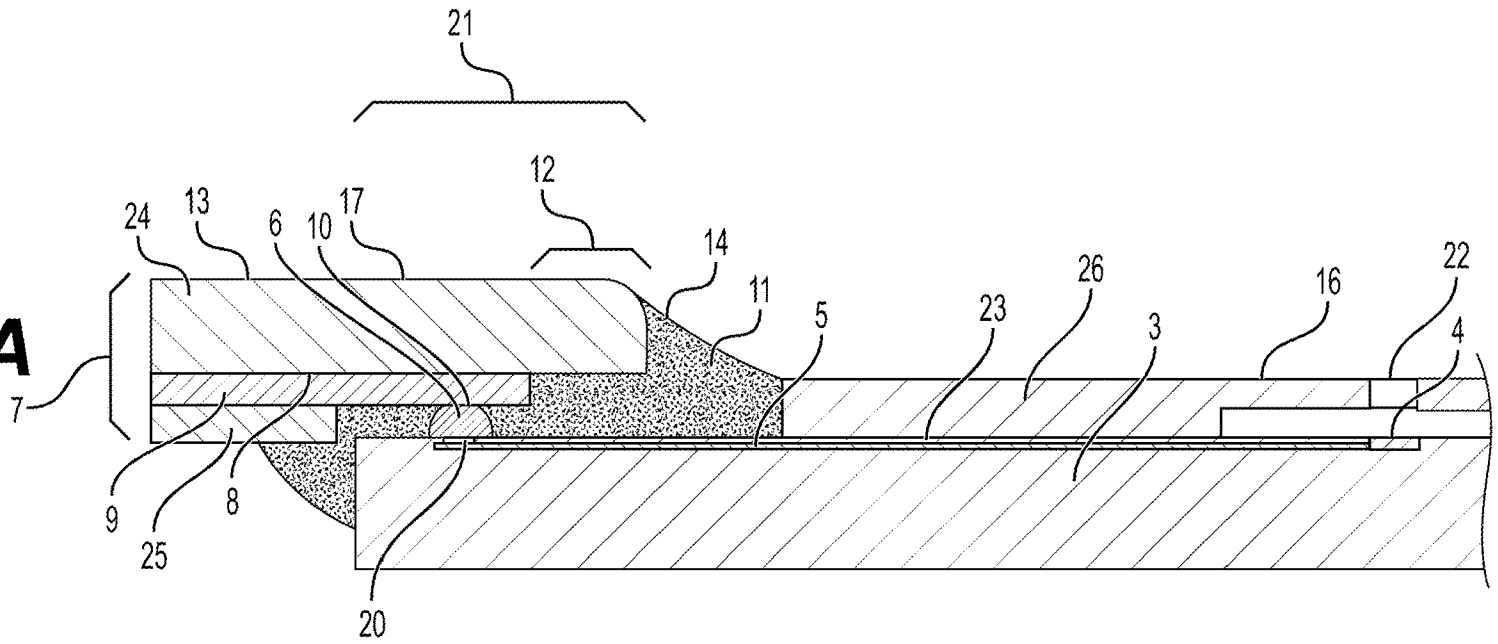
FIG. 3A is a cross-sectional view illustrating a liquid ejection head according to a second embodiment.

The inclination may be formed by partially changing the thickness of the leading region 12. For example, as illustrated in FIG. 3A, the thickness of at least a part of the leading region 12 in X direction (particularly the thickness of the base film 24) is reduced along X direction, thereby forming the inclination. The thickness of the overall leading region 12 may be changed in X direction or only a part of the leading region 12 (particularly a part near the leading end 14) may be changed in X direction. It is not necessary to incline the first surface 8 in the leading region 12. The first surface 8 may be parallel to the substrate 3 over the overlapping region 21. The thickness of the leading region 12 may be changed by trimming or stamping the base film. At this point, a corner formed by the end face of the leading end 14 and the second surface may be used as a structure having a curvature (in this case, the end face of the leading end 14 and the second surface do not form an edge). This can easily suppress damage to the wiper 15. In this case, the radius of curvature is preferably at least 20 μm and is more preferably at least 30 μm in consideration of the suppression of damage to the wiper. Moreover, the radius of curvature can be at most 50 μm in consideration of the strength of the leading end 14 of the base film 24.

Other points of the second embodiment may be identical to those of the first embodiment.

Third Embodiment

As illustrated in FIG. 4A, the overall leading region 12 in X direction may be bent with a curvature. In other words, the leading region 12 may be curved toward the substrate 3. Thus, the second surface 13 of the leading region 12 can be inclined toward the substrate 3. The leading region 12 may have a substantially constant thickness.

Other points of the third embodiment may be identical to those of the first embodiment.

[Sealer on the Inclined Part]

In the liquid ejection head 2 of the present invention, the inclined part of the leading region 12 (the second surface 13 partially inclining toward the substrate 3) may be partially covered with the sealer 11 (see FIGS. 3A and 4A). In other words, the sealer 11 may be provided from the electrical connection portion 10 to the second surface 13. The sealer 11 can be provided so as not to reach the starting position of the inclination of the second surface 13, in other words, the sealer 11 can be provided on a part of the inclined part near the leading end 14. The sealer 11 can be provided without exposing at least an edge formed by the end face of the leading end 14 and the second surface. Thus, it is not necessary to cover the overall inclined part with the sealer 11. In other words, the inclined part can be covered with the sealer 11 without forming a step on the leading end 14.

If the sealer 11 is also provided on the second surface 13, a contact area increases between the sealer 11 and the flexible printed circuits 7, thereby more firmly fixing the flexible printed circuits 7 to the substrate 3. The formation of the sealer 11 on the second surface 13 can increase the area of the interface between the flexible printed circuits 7 and the sealer 11 as compared with the absence of the sealer 11 on the second surface 13. With the configuration, in the event of an inflow of liquid from the interface, the liquid reaches the conductive pattern 9 from a considerable distance. This can easily suppress the arrival of the liquid at the conductive pattern 9, thereby easily improving the resistance of the liquid ejection head 2 and maintaining high-quality recording.

The height of the sealer 11 on the second surface 13 can be lower than or equal to the height h1 of the uppermost part 17 of the flexible printed circuits 7. The height of the sealer 11, in particular, can be lower than the height h1 of the uppermost part 17. This is because a distance between the liquid ejection face 16 and a target of ejection (e.g., a recording medium) can be easily reduced. The configuration is effectively used for achieving high image quality.

[Clearance Between the Leading Region and the Substrate]

In the liquid ejection head 2 of the present invention, as illustrated in FIG. 3A, at least a part of the leading region 12 of the flexible printed circuits 7 in Y direction can be separated from the substrate 3. The leading region 12 and the substrate 3 may be separated from each other over the flexible printed circuits 7 in Y direction. In this case, the bottom edge of the leading end 14 does not come into contact with the substrate 3 in Y direction. Alternatively, the leading region 12 and the substrate 3 may be separated from each other only in a part of the flexible printed circuits 7 in Y direction. In this case, the bottom edge of the leading end 14 comes into contact with a part of the substrate 3 and does not come into contact with the other part of the substrate 3 in Y direction. The liquid ejection heads according to the first and third embodiments also have a clearance between the leading region 12 and the substrate 3 in Y direction, which is not illustrated in FIGS. 2A and 4A.

In the structure where a clearance is formed between the leading region 12 and the substrate 3, the sealer 11 can be disposed in the clearance. Thus, if the inclined part of the second surface 13 of the leading region 12 is partially covered with the sealer 11, the sealer 11 covering the electrical connection portion 10 and the sealer 11 covering the second surface 13 can be combined. In other words, the sealer 11 covering the electrical connection portion 10 and the sealer 11 covering the second surface 13 can be a combined sealer of the same material. In this case, when covering the electrical connection portion 10, the sealer 11 can be also provided on the second surface 13 of the leading region 12. An interface of different materials is likely to cause an inflow of liquid. Thus, the sealer 11 covering the electrical connection portion 10 and the sealer 11 covering the second surface 13 are made of the same material, thereby achieving the effect of suppressing an inflow of liquid and improving the resistance of the liquid ejection head 2.

Even if the second surface 13 of the leading region 12 is not covered with the sealer (FIG. 2A), the end face of the leading end 14 of the leading region can be covered with the same sealer as that covering the electrical connection portion 10. If the sealer 11 is provided on the end face of the leading end 14, the surface of the sealer 11 can continue to the liquid ejection face 16 (without forming a step).

In order to provide a clearance between the leading region 12 and the substrate 3 as described above, the leading region 12 can be partially or entirely floated from the substrate 3. Thus, the leading end 14 of the leading region 12 may be formed into a wavy part or a notch may be formed on the leading end 14.

The exemplary embodiments of the present invention were described in the foregoing description. The present invention is not limited to the embodiments and can be modified and changed in various ways within the scope of the invention. Specific examples will be described below to illustrate the detail of the present invention.

EXAMPLES

Example 1

Figure 2B:
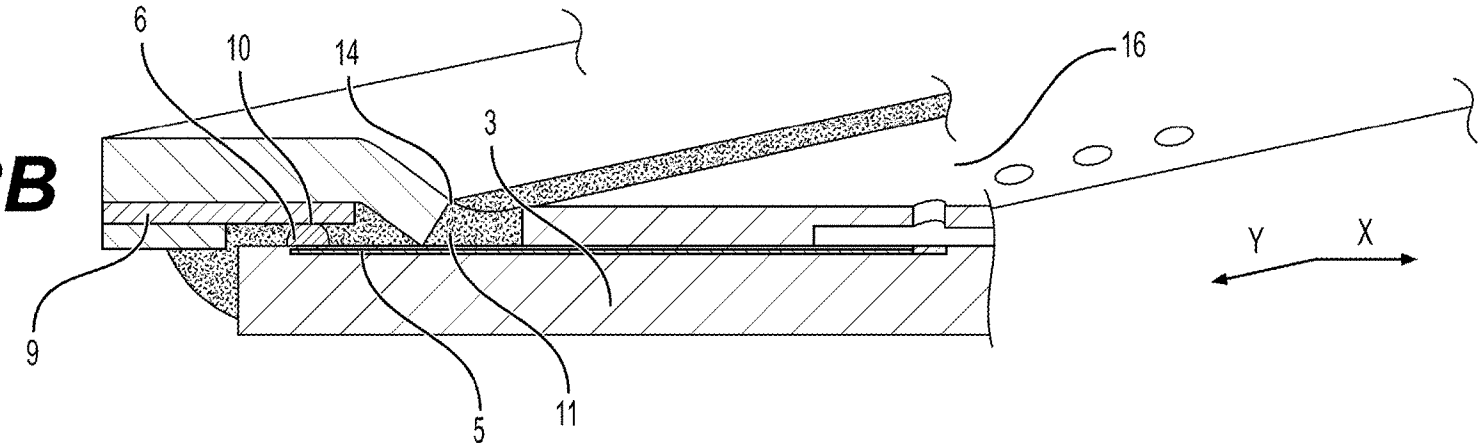
FIG. 2B is a cross-sectional perspective view illustrating the liquid ejection head according to the first embodiment.

The liquid ejection head according to the present example had the structure illustrated in FIGS. 2A and 2B. The energy generator 4 was a heater. The bump 6 was formed on the wire 5 provided on the substrate 3 with the electrode pad 20 interposed between the wire 5 and the bump 6. The electrical connection portion 10 was disposed between the bump 6 and the conductive pattern 9 of the flexible printed circuits 7. An electric signal and power are supplied from the conductive pattern 9 to the energy generator 4 through the wire 5, so that liquid was heated and foamed and then was ejected from the outlet 22. The substrate 3 was a silicon plate having a thickness of 625 μm. The wire 5 was a wire layer including four layers of aluminum metal wires. The wire layer was 6 μm in thickness. A $SiO_2$ layer having a thickness of 300 nm was provided as the protective film 23 on the upper side of the uppermost layer of the wire layer. The bump 6 was a gold stud bump. 71 bumps that are about 100 μm in diameter were formed with 200-μm pitches.

The flexible printed circuits 7 included a polyimide film having a thickness of 70 μm as the base film 24 and had an outside shape of 50 mm×14 mm. On the first surface 8 of the base film 24, the 71 line-and-space conductive patterns 9 that are 100 μm in width were formed with 200-μm pitches. The conductive pattern had a thickness of about 30 μm and was formed by coating a copper surface with gold. The leading region 12 was a 200-μm region extending from the leading end 14 of the flexible printed circuits 7. The conductive patterns 9 were not formed in the region. The total thickness of the bump 6 and the conductive pattern 9 at the electrical connection portion 10 was about 100 μm. Thus, in a part where the bumps 6 are formed, a clearance between the first surface 8 of the base film and the surface of the substrate 3 was about 100 μm. The leading region 12 entirely inclined toward the substrate 3. The electrical connection portion 10 was covered with the sealer 11 made of epoxy resin. The sealer 11 extended to one side of the substrate 3 (the left end face of the substrate 3 in FIG. 2A).

The leading region 12 was partially separated from the substrate 3 in Y direction, which is not illustrated in FIG. 2A. In other words, the leading region 12 was partially floated from the substrate 3. The sealer 11 was also provided in a clearance between the leading region 12 of the flexible printed circuits 7 and the substrate 3. The sealer 11 was also provided on the end face of the leading end 14 but was not provided on the second surface 13.

The height h1 from the substrate 3 to the uppermost part 17 of the flexible printed circuits 7 was higher than a height from the substrate 3 to the liquid ejection face 16. In the structure, particularly when the liquid ejection face 16 is cleaned with the wiper 15 in a recovering operation, the wiper 15 is likely to come into contact with the uppermost part 17 of the flexible printed circuits 7. However, the leading region 12 inclined toward the substrate 3 and the edge height h2 of the leading end 14 of the flexible printed circuits 7 was at least about 50 μm lower than the height h1 of the uppermost part 17 of the flexible printed circuits 7. This prevented the wiper 15 from coming into contact with the edge of the leading end 14 of the flexible printed circuits 7 during a recovering operation, thereby suppressing damage to the wiper. The smaller the difference between the height h1 of the uppermost part 17 and the height of the liquid ejection face 16, the closer the liquid ejection face 16 to a printed medium. This reduces a displacement of liquid in the ejection direction, improving printing quality. A difference between the height h1 of the uppermost part 17 and the height of the liquid ejection face 16 is preferably 300 μm or less, and more preferably 150 μm or less.

Comparative Example 1

Figure 6A:
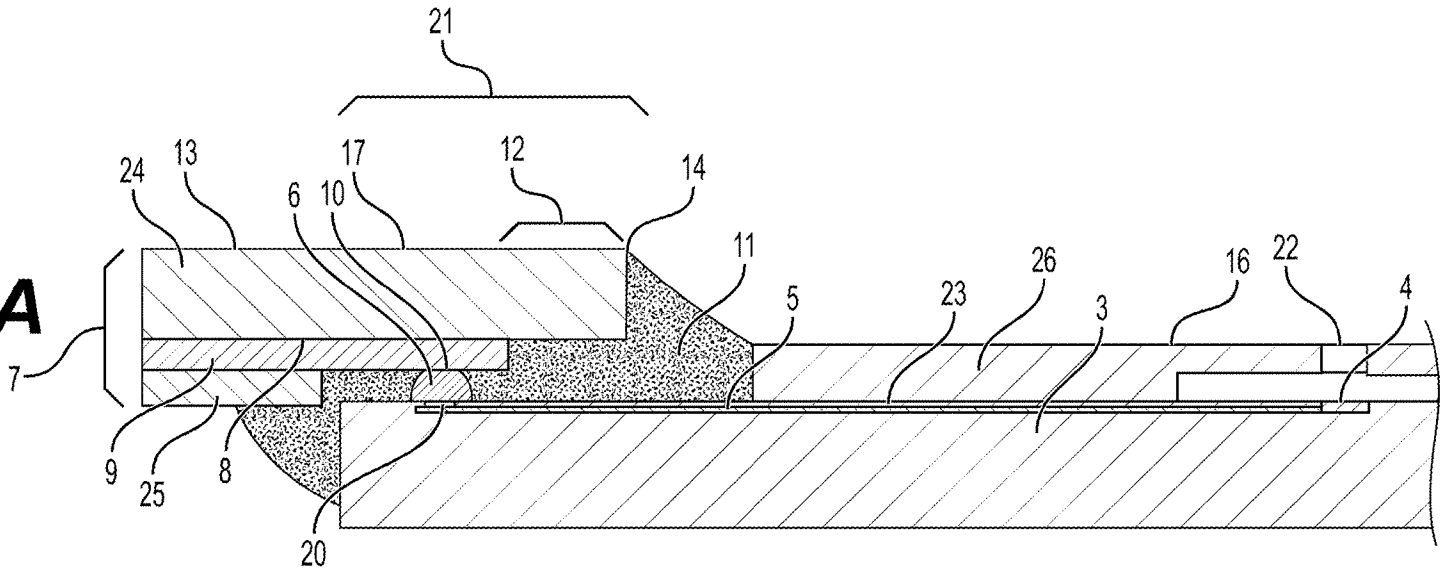
FIG. 6A is a cross-sectional view illustrating the liquid ejection head according to Comparative Example 1.
Figure 6B:
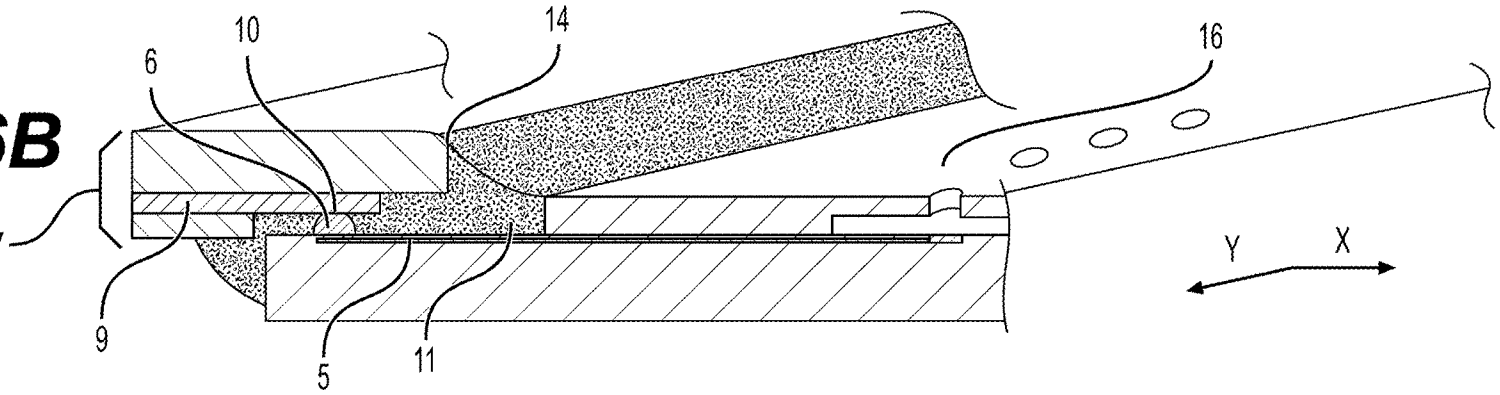
FIG. 6B is a cross-sectional perspective view illustrating the liquid ejection head according to Comparative Example 1.

As illustrated in FIG. 6A, in the liquid ejection head of the present comparative example, the flexible printed circuits 7 were attached to the substrate 3 according to a mounting method using ordinary underfill. The end face of the leading end 14 of the flexible printed circuits 7 was covered with the underfill so as to form a so-called fillet shape. The second surface 13 of the leading region 12 was almost flat and did not incline toward the substrate 3. Thus, the edge height h2 of the leading end 14 of the flexible printed circuits 7 was equal to the height h1 of the uppermost part 17 of the flexible printed circuits 7. Other points were identical to those of Example 1.

Figure 7A:
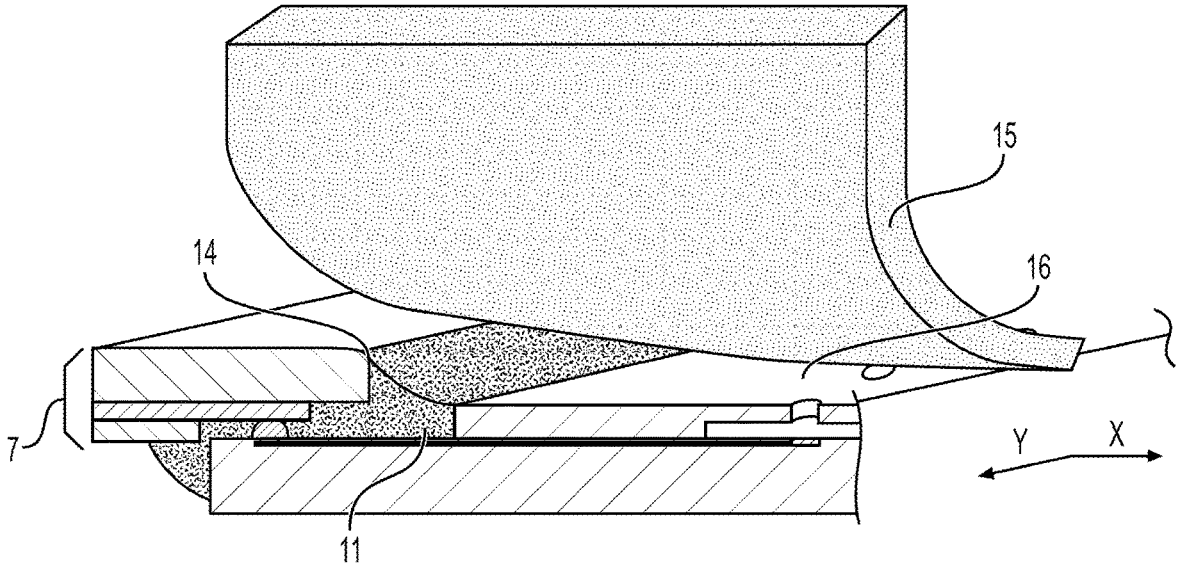
FIG. 7A is a schematic diagram for describing wiping of the liquid ejection head according to Comparative Example 1 when the wiper is moved in parallel with the width direction of the flexible printed circuits.
Figure 7B:
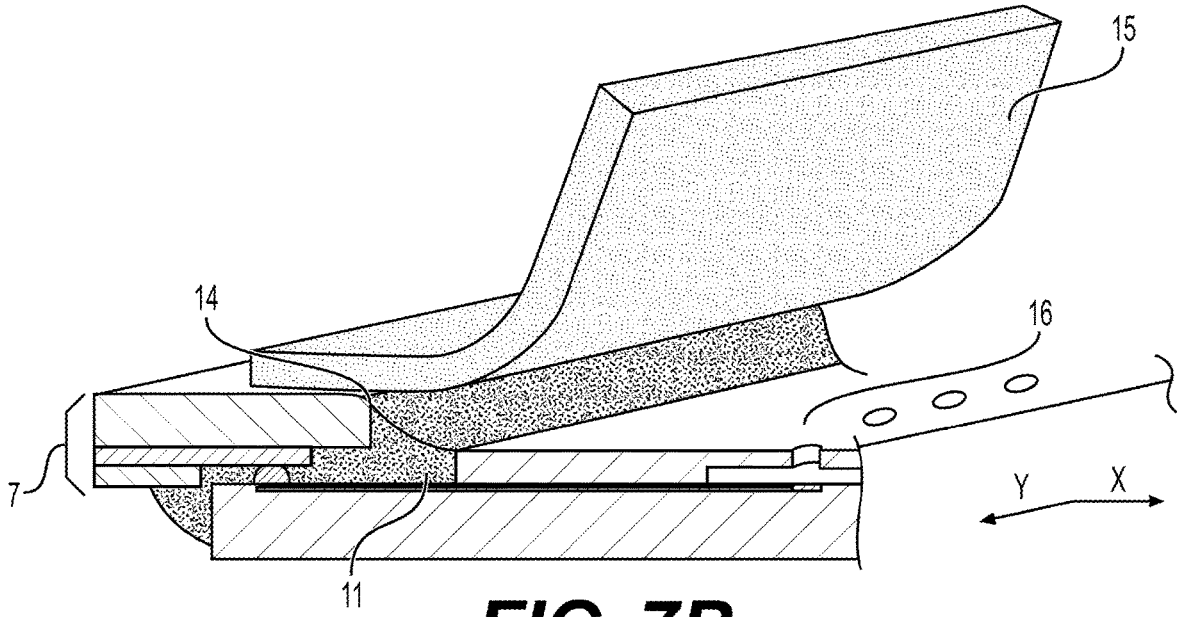
FIG. 7B is a schematic diagram for describing wiping of the liquid ejection head according to Comparative Example 1 when the wiper is moved perpendicularly to the width direction of the flexible printed circuits.

FIGS. 7A and 7B are schematic diagrams for describing wiping of the liquid ejection head according to Comparative Example 1. FIG. 7A illustrates that the wiper moves in parallel with the width direction of the flexible printed circuits. FIG. 7B illustrates that the wiper moves perpendicularly to the width direction. In the liquid ejection head, the wiper 15 was also brought into contact with the edge of the leading end 14 of the flexible printed circuits 7 in each recovering operation, so that the wiper was more likely to be damaged than in Example 1. In order to suppress the contact of the wiper 15 with the edge, if the underfill used as the sealer 11 is provided over a part of the second surface 13 of the leading region 12 from the edge, a distance between the liquid ejection face 16 and a target of ejection may increase and cause image degradation.

Example 2

Figure 3B:
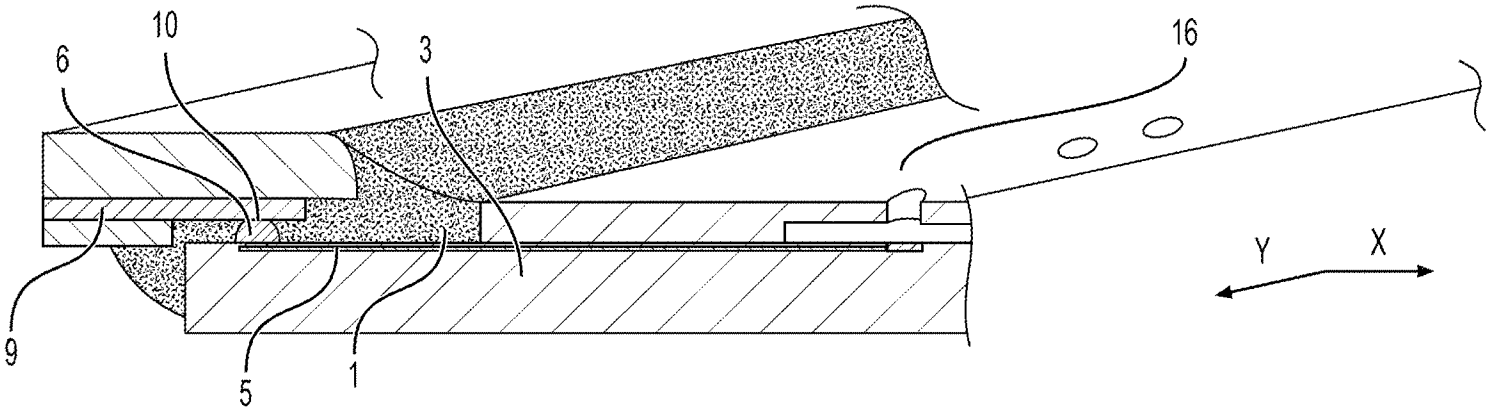
FIG. 3B is a cross-sectional perspective view illustrating the liquid ejection head according to the second embodiment.

The liquid ejection head according to the present example had the structure illustrated in FIGS. 3A and 3B. The present example was different from Example 1 in the shape of the leading region 12 of the flexible printed circuits 7. The leading region 12 decreased in thickness in X direction in a 40-μm region extending from the leading end 14 of the leading region 12 (a 40-μm region extending to the left in FIGS. 3A and 3B). This inclined the second surface 13 in the leading region 12. In the part where the thickness changes, a radius of curvature changed from 20 μm to 30 μm. Moreover, the sealer 11 was integrally provided from the electrical connection portion 10 partially to the part where the thickness changes. The sealer 11 covered the leading end 14 and extended so as to cover a part of the inclined face.

Other points of the liquid ejection head of the present example were identical to those of Example 1. The present example obtained the same effect as Example 1.

Example 3

Figure 4B:
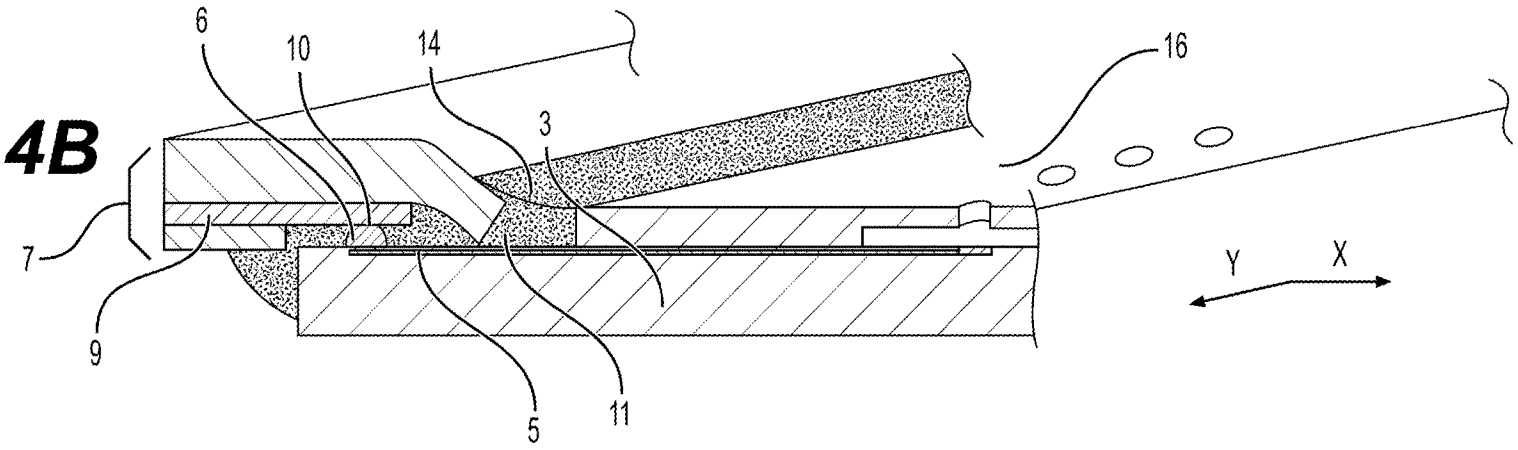
FIG. 4B is a cross-sectional perspective view illustrating the liquid ejection head according to the third embodiment.

The liquid ejection head according to the present example had the structure illustrated in FIGS. 4A and 4B. The overall leading region 12 in X direction was bent with a curvature. In other words, the leading region 12 was curved toward the substrate 3. This inclined the second surface 13 toward the substrate 3. The radius of curvature of the curve changed from 200 μm to 300 μm. The edge height h2 of the leading end 14 of the flexible printed circuits 7 was at least about 50 μm lower than the height h1 of the uppermost part 17 of the flexible printed circuits 7. Moreover, the sealer 11 was integrally provided from the electrical connection portion 10 to the curved second surface 13.

Other points of the liquid ejection head of the present example were identical to those of Example 1. The present example obtained the same effect as Example 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-147528, filed Aug. 9, 2019, which is hereby incorporated by reference herein in its entirety.

What is claimed is:

1. A liquid ejection head comprising:

a substrate;

an energy generator that is provided on the substrate and generates energy for ejecting liquid;

an electrode portion that is provided on the substrate and is electrically connected to the energy generator;

a liquid ejection face that is provided on a side of a surface of the substrate on which the electrode portion is provided; and a flexible printed circuit board including a conductive pattern electrically connected to the electrode portion and a base material having a first surface and a second surface, the first surface being opposed to the surface of the substrate on which the electrode portion is provided, and the second surface being provided on an opposite side from the first surface, wherein the conductive pattern is provided in contact with the first surface, wherein the base material of the flexible printed circuit board has a leading region from a terminal end of a region having the conductive pattern to an end of the base material closer to the energy generator, the conductive pattern not being formed in the leading region, and wherein at least a part of the second surface of the leading region inclines toward the substrate.

2. The liquid ejection head according to claim 1, wherein at least a part of the leading region bends with a curvature, so that at least the part of the second surface inclines.

3. The liquid ejection head according to claim 1, wherein a thickness of at least a part of the leading region varies, so that at least the part of the second surface inclines.

4. The liquid ejection head according to claim 1, further comprising a sealant covering an electrical connection portion between the electrode portion and the conductive pattern, wherein the inclined part of the second surface is partially covered with the sealant.

5. The liquid ejection head according to claim 4, wherein at least a part of the leading region is separated from the substrate in a direction orthogonal to a direction from the conductive pattern to an end of the leading region closer to the energy generator.

6. The liquid ejection head according to claim 4, wherein a height of the sealant from the surface of the substrate on which the electrode portion is provided is lower than a highest part of the second surface from the surface of the substrate on which the electrode portion is provided.

7. A liquid ejecting apparatus comprising:

a liquid ejection head including a substrate; an energy generator that is provided on the substrate and generates energy for ejecting liquid; an electrode portion that is provided on the substrate and is electrically connected to the energy generator; a liquid ejection face that is provided on a side of a surface of the substrate on which the electrode portion is provided; and a flexible printed circuit board including a conductive pattern electrically connected to the electrode portion and a base material having a first surface and a second surface, the first surface being opposed to the surface of the substrate on which the electrode portion is provided, and the second surface being provided on an opposite side from the first surface; and a wiper for wiping the liquid ejection face, wherein the conductive pattern is provided in contact with the first surface, wherein the base material of the flexible printed circuit board has a leading region from a terminal end of a region having the conductive pattern to an end of the base material closer to the energy generator, the conductive pattern not being formed in the leading region, and wherein at least a part of the second surface of the leading region inclines toward the substrate.

8. The liquid ejection apparatus according to claim 7, wherein at least a part of the leading region of the liquid ejection head bends with a curvature, so that at least the part of the second surface inclines.

9. The liquid ejection apparatus according to claim 7, wherein a thickness of at least a part of the leading region of the liquid ejection head varies, so that at least the part of the second surface inclines.

10. The liquid ejection apparatus according to claim 7, wherein the liquid ejection head further comprises a sealant covering an electrical connection portion between the electrode portion and the conductive pattern, and wherein the inclined part of the second surface is partially covered with the sealant.

11. The liquid ejection apparatus according to claim 10, wherein at least a part of the leading region of the liquid ejection head is separated from the substrate in a direction orthogonal to a direction from the conductive pattern to an end of the leading region closer to the energy generator.

12. The liquid ejection apparatus according to claim 10, wherein a height of the sealant from the surface of the substrate on which the electrode portion is provided is lower than a highest part of the second surface from the surface of the substrate on which the electrode portion is provided.

* * * * *